US005829400A

United States Patent [19]

Speil et al.

[11] Patent Number: 5,829,400

[45] Date of Patent: Nov. 3, 1998

[54] VALVE GEAR FOR AN INTERNAL COMBUSTION ENGINE

[75] Inventors: Walter Speil, Ingolstadt; Michael Haas, Weisendorf, both of Germany

[73] Assignee: Ina Walzlager KG, Germany

[21] Appl. No.: 952,828

[22] PCT Filed: Dec. 6, 1995

[86] PCT No.: PCT/EP95/04792

§ 371 Date: Nov. 25, 1997

§ 102(e) Date: Nov. 25, 1997

[87] PCT Pub. No.: WO96/37687

PCT Pub. Date: Nov. 28, 1996

[30] Foreign Application Priority Data

May 26, 1995 [DE] Germany ..... 195 19 399.7

[51] Int. Cl.[6] ..... F01L 1/26

[52] U.S. Cl. ..... 123/90.22; 123/90.27

[58] Field of Search ..... 123/90.22, 90.27, 123/90.39, 90.4

[56] References Cited

U.S. PATENT DOCUMENTS

| | | | |
|---|---|---|---|
| 4,660,529 | 4/1987 | Yoshikawa | 123/432 |
| 4,809,663 | 3/1989 | De Tomaso | 123/432 |
| 5,228,419 | 7/1993 | Nonogawa | 123/90.22 |
| 5,303,680 | 4/1994 | Nielson | 123/90.22 |
| 5,445,117 | 8/1995 | Mendler | 123/90.22 |

FOREIGN PATENT DOCUMENTS

| | | |
|---|---|---|
| 2662743 | 12/1991 | France . |
| 3901225 | 8/1989 | Germany . |
| 4039256 | 6/1992 | Germany . |
| 4338845 | 5/1995 | Germany . |

OTHER PUBLICATIONS

Von Wilhelm und Franz Lukas Article (pgs. 680–688) 1994.

*Primary Examiner*—Weilun Lo
*Attorney, Agent, or Firm*—Bierman, Muserlian and Lucas

[57] ABSTRACT

In a valve drive (1) for the simultaneous actuation of, for instance, three equally acting gas exchange valves (2), longitudinal axes of the gas exchange valves (2) are arranged so as to include an angle therebetween wherein a bridge (4) is arranged between the cams of a camshaft (3) and the gas exchange valves (2), and the longitudinal axis (9) of the guide means (5) of the bridge (4) extends parallel to a bisectrix (10) between the longitudinal axes of the gas exchange valves **(2*a*, 2*b*)**.

11 Claims, 2 Drawing Sheets

VALVE GEAR FOR AN INTERNAL COMBUSTION ENGINE

FIELD OF THE INVENTION

The invention concerns a valve drive of an internal combustion engine comprising at least two equally acting gas exchange valves loaded in lifting direction by at least one cam of a camshaft, said gas exchange valves extending at a small, defined angle to each other.

BACKGROUND OF THE INVENTION

Multi-valve drives of the aforesaid type are being increasingly used in engine construction. The technical journal MTZ—Motortechnische Zeitschrift—No. 2, 1995, for instance, describes a four-cylinder engine with a five-valve technique i.e., with three intake and two exhaust valves per cylinder. Therefore, five cup-shaped tappets are required for each cylinder as transmitting elements. The intake valves are arranged on two different planes (two valves being arranged on a common plane), because the outer surface of the combustion chamber is domed and the available valve cross-section is limited. The loading of the intake valves disposed at a slant to one another necessitates a cam produced by complicated grinding for each intake valve.

OBJECT OF THE INVENTION

It is therefore an object of the invention to create a valve drive of the pre-cited type in which the aforesaid drawbacks are substantially eliminated and particularly to provide a simultaneous loading of at least two equally acting gas exchange valves using fewer parts and less complicated manufacturing procedures.

SUMMARY OF THE INVENTION

The valve drive (1) of the invention of an internal combustion engine comprising at least two equally acting gas exchange valves (2) loaded in lifting direction by at least one cam of a camshaft (3), said gas exchange valves (2) extending at a small, defined angle to each other, is in that a cam follower is arranged in driving relationship between the cam(s) and the gas exchange valves, the cam follower comprising a bridge which is guided for linear displacement relative to a cylinder head of the external combustion engine by guide means, and a longitudinal axis extending through the guide means of the bridge is at least approximately parallel to a bisector of the angle, or the longitudinal axis extending through the guide means is approximately parallel to a longitudinal axis situated between the longitudinal axes of the gas exchange valves, along which longitudinal axis, a sum of the reaction forces acting from the bridge on the guide means is zero or minimal.

The bridge described herein which, for example, can have a girder-like configuration, enables an equally acting loading of at least two gas exchange valves. Longitudinal axes of the gas exchange valves can extend, for example, so that their point of intersection is situated on the side of camshaft-proximate ends of the gas exchange valves (see description of figures). Thus only at least one cam is required for each cylinder and number of equally acting valves. Another minimal requirement consists in that only one transmitting element is required in the bridge for transmission to the gas exchange valve. At the same time, the otherwise complicated manufacturing of cams for each gas exchange valve is simplified.

An essential basic idea of the invention is to arrange the bridge so that the ends of the valve stems can only migrate to a small extent on the transmitting elements on the under surface of the bridge. This is achieved by the previously described arrangement of the guide means of the bridge parallel to a bisector between the planes of the gas exchange valves. Since, however, as is the case in the example of valve configuration, two same function gas exchange valves are situated on one common plane, a much larger reaction force is transmitted to the guide means by these two same function gas exchange valves than by the third gas exchange valve. According to the invention therefore, the guide means of the bridge is not necessarily arranged parallel to the bisector but parallel to a longitudinal axis along which the sum of the reaction forces acting from the bridge on the guide means is minimal.

However, the configuration and arrangement of the bridge of the invention does not apply only to the two and three valve technique (for same function gas exchange valves per cylinder) specifically described herein. If one considers, for instance, a valve drive with any desired number of same function gas exchange valves per cylinder, and these gas exchange valves are arranged, for example, at a slant to one another, or at a slant to one another and only partly along longitudinal axes which intersect the axis of the camshaft, the arrangement of the guide means of the bridge of the invention must be such that it assured either that the total migration of the gas exchange valves during valve lift on the transmitting elements provided in the bridge is as small as possible, or that the sum of the aforesaid reaction forces mentioned above is minimal.

Advantageously, one hydraulic clearance compensation element per valve is arranged as transmitting means in the bridge for transmission to the gas exchange valve. It is also conceivable, however, to use known mechanical adjusting devices or their combinations.

A particularly favorable embodiment of contacting elements for the cams in the bridge from the tribological point of view likewise forms a subject matter of the invention. Such contacting elements are configured in the form of rotating rollers or pins.

According to a further proposition of the invention, when the bridge is used for three equally acting gas exchange valves, the bridge is loaded by two equally acting cams each of which cooperates with one contacting means in the bridge.

Further, the counter surface of the transmitting element can be made slightly spherical or cylindrical so as to provide a sufficiently large contact surface for the gas exchange valve during its migration relative to the transmitting element during cam lift. It is equally conceivable to provide the transmitting element (clearance compensation element) with pivoting slide shoes known, per se, from the prior art.

It is advantageous for the oscillating masses in the valve drive, to make the bridge of the invention by a lightweight technique or of a light material such as aluminium. A construction out of a plastic is likewise suitable. However, it is also possible to make the bridge by a conventional method out of steel. Further, the configuration of the guide means for the bridge is not limited to the example of embodiment represented in the attached drawings. It is conceivable to use any guide means known from the state of the art.

DETAILED DESCRIPTION OF THE DRAWINGS

Figure 1:
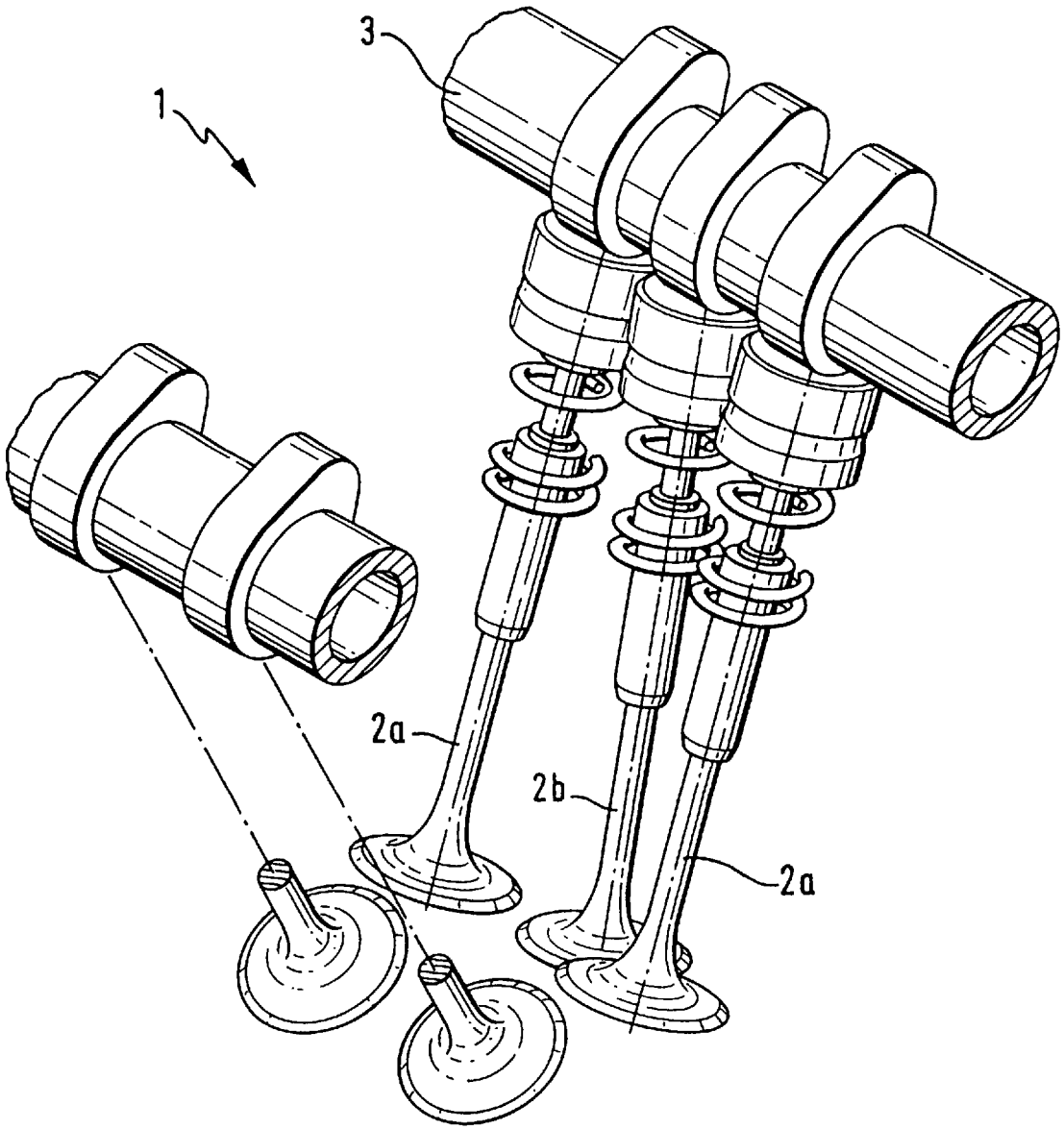
Fig. 1 PRIOR ART
FIG. 1 is a schematic representation of a prior art valve drive.

FIG. 1 shows a valve drive 1 of a generic type. This valve drive comprises three equally acting gas exchange valves 2 (intake valves). In this particular embodiment described here by way of example, two outer gas exchange valves 2*a* have longitudinal axes situated at least approximately on one common plane. In the longitudinal direction of a camshaft 3 whose cams load the gas exchange valves 2 in lifting direction, there is arranged between the gas exchange valves 2*a,* a further gas exchange valve 2*b* extending at an angle to the plane of the gas exchange valves 2*a*. The longitudinal axes of the gas exchange valves 2 roughly intersect the longitudinal axis of the camshaft 3.

Figure 2:
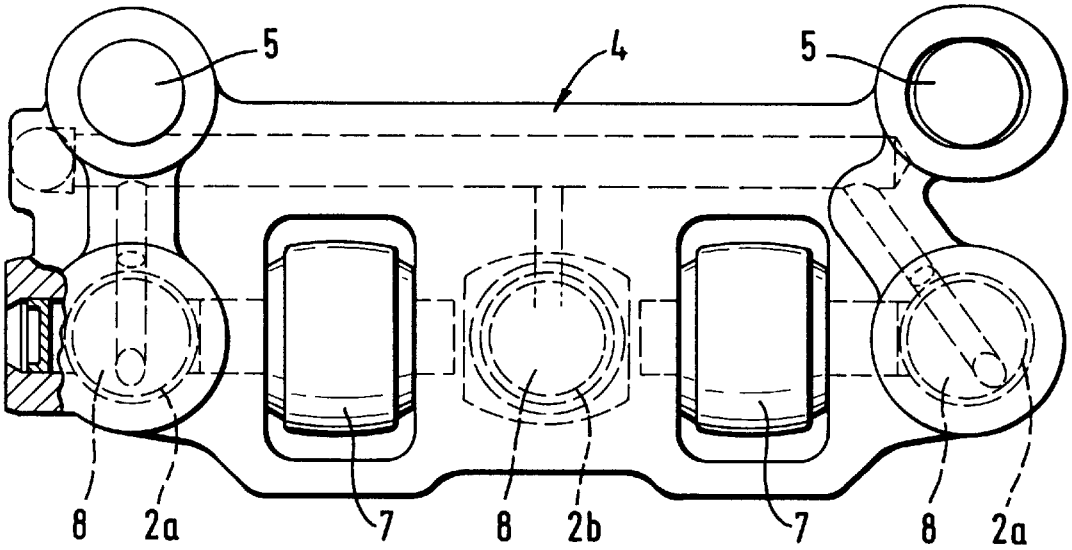
FIG. 2 shows a top view of a cam follower of the invention.
Figure 3:
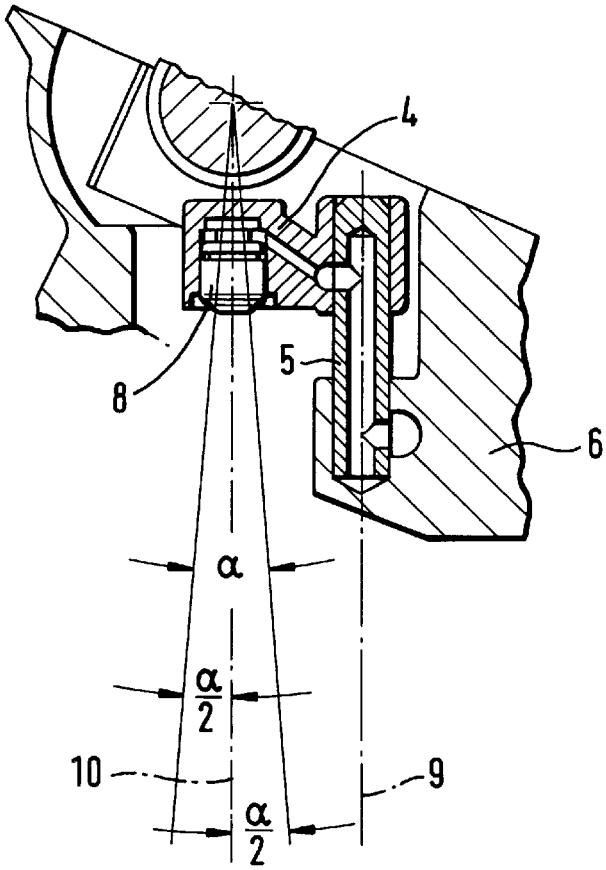
FIG. 3 is a partial cross-sectional view of the cam follower of the invention in the region of its guide means.

As can be seen from FIGS. 2 and 3, a bridge 4 is arranged between the cams of the camshaft 3 and the gas exchange valves 2. This bridge 4 is guided for linear displacement relative to a cylinder head 6 of an internal combustion engine by guide means 5 needing no further description here. On its side facing the cams, the bridge 4 comprises two rollers 7 serving as direct contacting elements for the cams of the camshaft 3. These rollers 7 permit a particularly low-friction transmission of the cam lift to the bridge 4. On its side facing the valves, the bridge 4 comprises transmitting elements in the form of one hydraulic clearance compensation element 8 for each gas exchange valve 2.

As can be seen from FIG. 3, a longitudinal axis 9 of the guide means 5 is arranged parallel to a bisector 10 between the plane extending through the longitudinal axes of the equally acting gas exchange valves 2*a* and the longitudinal axis of the gas exchange valve 2*b*. To form a sufficiently large contact surface for the end of the respective valve stem on the counter surface of the clearance compensation element 8, this counter surface (not shown) can be given a spherical or cylindrical shape. It is also conceivable, however, to have the axis of symmetry of each transmitting element extend approximately or exactly along the longitudinal axis of the respective gas exchange valve.

We claim:

1. A valve drive (1) of an internal combustion engine comprising at least two gas exchange valves (2) of the same function loaded in a lifting direction by at least one cam of a camshaft (3), said gas exchange valves (2) extending at a small, defined angle to each other, characterized in that a cam follower is arranged in driving relationship between the at least one cam and the gas exchange valves, the cam follower comprising a bridge (4) which is guided for linear displacement relative to a cylinder head (6) of the internal combustion engine by guide means (5), and a longitudinal axis (9) extending through the guide means (5) of the bridge (4) is substantially parallel to a bisector (10) of the angle, or the longitudinal axis extending through the guide means (5) is substantially parallel to a longitudinal axis situated between the longitudinal axes of the gas exchange valves (2) wherein a sum of the reaction forces acting from the bridge (4) on the guide means (5) is substantially zero.

2. A valve drive of claim 1 comprising three of the gas exchange valves (2) of the same function of which two first gas exchange valves (2*a*) have longitudinal axes situated approximately on one common plane, there being arranged in a longitudinal direction of the camshaft between said two first gas exchange valves (2*a*), a further gas exchange valve (2*b*) which extends at an angle to said common plane, wherein the longitudinal axis (9) of the guide means (5) of the bridge (4) extends approximately parallel to a plane which is situated between the common plane of the first gas exchange valves (2*a*) and a bisector between the common plane of the first gas exchange valves (2*a*) and the longitudinal axis of the further gas exchange valve (2*b*).

3. A valve drive of claim 1 wherein the longitudinal axis of at least one of the gas exchange valves (2) intersects the longitudinal axis of the camshaft.

4. A valve drive of claim 1 wherein at least one hydraulic clearance compensation element (8) is arranged in the bridge (4) to face the gas exchange valves (2) and act as a transmitting element to the gas exchange valves (2).

5. A valve drive of claim 1 wherein cam contacting elements in the bridge (4) are configured as rotating rollers or pins (7).

6. A valve drive of claim 5 wherein, the bridge (4) is loaded by two equally acting cams each of which is situated opposite one roller (7) arranged in the bridge (4).

7. A valve drive of claim 2 wherein, seen in a top view of the bridge (4), the further gas exchange valve (2*b*) is located between the two cam contacting elements.

8. A valve drive of claim 2 wherein the longitudinal axis of at least one of the gas exchange valve (2) intersects the longitudinal axis of the camshaft.

9. A valve drive of claim 2 wherein at least one hydraulic clearance compensation element (8) is arranged in the bridge (4) to face the gas exchange valves (2) and act as a transmitting element to the gas exchange valves (2).

10. A valve drive of claim 2 wherein cam contacting elements in the bridge (4) are configured as rotating rollers or pins (7).

11. A valve drive of claim 6 wherein, seen in a top view of the bridge (4), the futher gas exchange valve (2*b*) is located between the two cam contacting elements.

* * * * *